US006084562A

United States Patent [19]

Onda

[11] Patent Number: 6,084,562

[45] Date of Patent: Jul. 4, 2000

[54] FLAT-PANEL DISPLAY DEVICE AND DISPLAY METHOD

[75] Inventor: Yasuyuki Onda, Miki, Japan

[73] Assignee: Kabushiki Kaisha Toshiba, Kawasaki, Japan

[21] Appl. No.: 09/052,927

[22] Filed: Apr. 1, 1998

[30] Foreign Application Priority Data

Apr. 2, 1997 [JP] Japan ..... 9-083948

[51] Int. Cl.[7] ..... G09G 3/36

[52] U.S. Cl. ..... 345/94; 345/96; 349/149

[58] Field of Search ..... 345/90–94, 96; 349/149, 150, 152

[56] References Cited

U.S. PATENT DOCUMENTS 5,301,031 4/1994 Eto et al. ..... 348/792

5,757,352 5/1998 Miyamoto et al. ..... 345/94

5,892,494 4/1999 Kimura et al. ..... 345/96

*Primary Examiner*—Steven J. Saras

*Assistant Examiner*—Tewolde Mengisteab

*Attorney, Agent, or Firm*—Oblon, Spivak, McClelland, Maier & Neustadt, P.C.

[57] ABSTRACT

In a liquid crystal display device, an X-driver circuit and a Y-driver circuit are associated with each other to thin out image to be displayed in a display area, under the control of a control circuit. A common electrode drive circuit supplies a common electrode signal to a common electrode under the control of the control circuit. In a canceled scanning period, average-correction is performed to average a polarity inversion time of the common electrode signal for driving the common electrode.

18 Claims, 8 Drawing Sheets

FLAT-PANEL DISPLAY DEVICE AND DISPLAY METHOD

BACKGROUND OF THE INVENTION

The present invention relates to a flat-panel display device such as a liquid crystal display device, and a display method of the same.

A flat-panel display device has characteristics of being thin and light-weight, and low power consumption, and is widely used in various fields as display devices of personal computers or word processors, display devices of television receivers, car navigation systems or game machines, and display devices of projection type, because of the characteristics.

In particular, research and development of an active matrix liquid crystal display device in which switch elements are electrically connected to display pixels has been vigorously effected due to the feature that an excellent display image can be obtained without cross-talk between adjacent pixels.

In the active matrix liquid crystal display device, a plurality of thin film transistors (TFTs) are formed near intersections between scanning lines and signal lines, and used as switching elements each for selectively driving a corresponding one of the pixel electrodes. In each TFT, the gate is connected to a scanning line, the drain is connected to a signal line and the source is connected to a pixel electrode. The TFT supplies a signal voltage from the signal line to the pixel electrode, when it is turned on upon rise of a scanning pulse supplied from the scanning line. Thus, a liquid crystal capacitance between the pixel electrode and a common electrode is charged, and the charge is maintained even after the TFT is turned off upon fall of the scanning pulse.

When the electric field in a liquid crystal cell is maintained in one direction, materials other than the liquid crystal are moved in the liquid crystal cell by the electric field and concentrated at one electrode side. This is a factor of making the lifetime of the liquid crystal cell short. Conventionally, there is a frame-inversion technique known as a measure for solving the above problem by inverting the polarity of a signal voltage with respect to the potential of the common electrode such that the direction of the electric field is reversed in every frame period. Further, there is a line-inversion technique of inverting the polarity of the signal voltage also in every horizontal scanning to reduce flicker. Moreover, there is a common inversion driving technique which causes a common electrode drive circuit to output a common electrode drive signal whose polarity is positively inverted with respect to a reference potential in synchronism with a frame-inversion period and a line-inversion period, for the purpose of preventing an increase in amplitude of the signal voltage. In this case, the signal voltage is level-inverted with reference to the center level thereof, and the common electrode drive signal is inverted from one of a high-level driving signal and a low-level driving signal to the other, every time the signal voltage is level-inverted.

In the case of a flat-panel display device, the number of scanning lines is preset to a specific value for the device. However, if such a display device having a preset number of scanning lines performs a display operation on the basis of a video signal having scanning lines the number of which exceeds the preset number, a simplified image is generally displayed in the entire display area by thinning out an excessive number of scanning lines from the video signal during multiple scannings.

For example, if a display device having only 234 scanning lines for the NTSC system performs a display operation on the basis of a video signal having an increased number of scanning lines for the PAL system or the like, there is a technique in which specific lines of a video signal each corresponding to one of successive six lines, for example, are canceled in one field.

Further, it is known that the regularity in the thin-out operation can be moderated by alternately canceling one of six lines and one of eight lines.

Under the circumstances, it was discovered through the assiduous research of the present inventors that display failure or shortening of the lifetime of liquid crystal may occur due to the regularity of the thin-out operation.

BRIEF SUMMARY OF THE INVENTION

An object of the present invention is to provide a flat-panel display device in which an image is not deteriorated or the lifetime of liquid crystal is not shortened, regardless of a change in the thin-out rate with respect to the number of scanning lines present in the device or the number of scanning lines present in the video signal.

In the flat-panel display device of the present invention, the polarity of a common electrode can be average-corrected according to the state of an input polarity inversion signal in one scanning period during which scanning is suspended to thin out a display image corresponding to a video signal transmitted continuously. Since unevenness of the polarity is moderated in each frame period, the lifetime of liquid crystal can be prevented from being shortened and the display image can be prevented from being deteriorated.

According to the present invention, there is provided a flat-panel display device which comprises a display area having a plurality of pixels; a common electrode for electrically affecting each of the pixels; a video signal supplying section for scanning the display area and supplying a video signal to the display area; a common electrode driving section for supplying to the common electrode a driving signal whose polarity is inverted; a first control section for controlling the video signal supplying section to thin out the video signal to be supplied to the display area by suspending the scanning; and a second control section for controlling the common electrode driving section such that unevenness of the polarity of the common electrode is average-corrected by the driving signal in a period during which scanning is suspended.

The second control section includes a circuit for correcting unevenness of the polarity of the common electrode on an average for every three scanning lines.

The first control section includes a circuit for causing the video signal supplying section to cancel one scanning line selected from an odd-number of scanning lines.

The second control section includes a circuit for causing the polarity of the driving signal to be reversed between a former half and a latter half of the scanning suspended period.

The second control section includes a circuit for reducing an amplitude of the driving signal in the scanning suspended period to be half a maximum amplitude of that in another period.

Further, according to the present invention, there is provided a display method of a flat-panel display device which comprises a step of scanning a display area formed of pixels to supply a video signal thereto; a step of supplying a driving signal whose polarity is inverted to a common electrode for electrically affecting each of the pixels; a step of suspending scanning to thin out the video signal to be supplied to the display area; and a step of causing the driving signal to be supplied such that unevenness of the polarity of the common electrode is average-corrected in a period during which scanning is suspended.

Furthermore, according to the present invention, there is provided a flat-panel display device which comprises: a display panel including a display area having n lines of display pixels each of which includes a light-modulation layer responding to an electric field between a common electrode and a pixel electrode; a video signal supplying section for supplying a video signal, whose polarity is inverted with respect to a first reference voltage in a clock of an integer number of times a horizontal scanning clock, to the corresponding pixel electrodes of each horizontal pixel line; and a common electrode driving section for supplying a common electrode voltage, whose polarity is inverted with respect to a second reference voltage to the common electrode in synchronism with the clock; wherein the flat-panel display device further comprises: a first control section for, in a case where the video signal includes m (m>n) image scanning line signals per vertical scanning period, inhibiting the image scanning line signal from being supplied to the display pixels of the horizontal pixel lines for a predetermined period; and a second control section for causing an average value of the common electrode voltage in the predetermined period to substantially coincide with the second reference voltage.

With the flat-panel display device of the present invention, as described above, unevenness of the polarity inverted signal supplied to the common electrode is average-corrected for at most three scanning periods. Therefore, even when one line selected from every even-number of scanning lines is canceled, the quality of an image or the lifetime of liquid crystal can be improved. Further, since one line selected from every odd-number of scanning lines can be uniformly canceled, image information can be displayed more accurately.

DETAILED DESCRIPTION OF THE INVENTION

A liquid crystal display device according to an embodiment of the present invention will be described with reference to the drawings.

Figure 1:
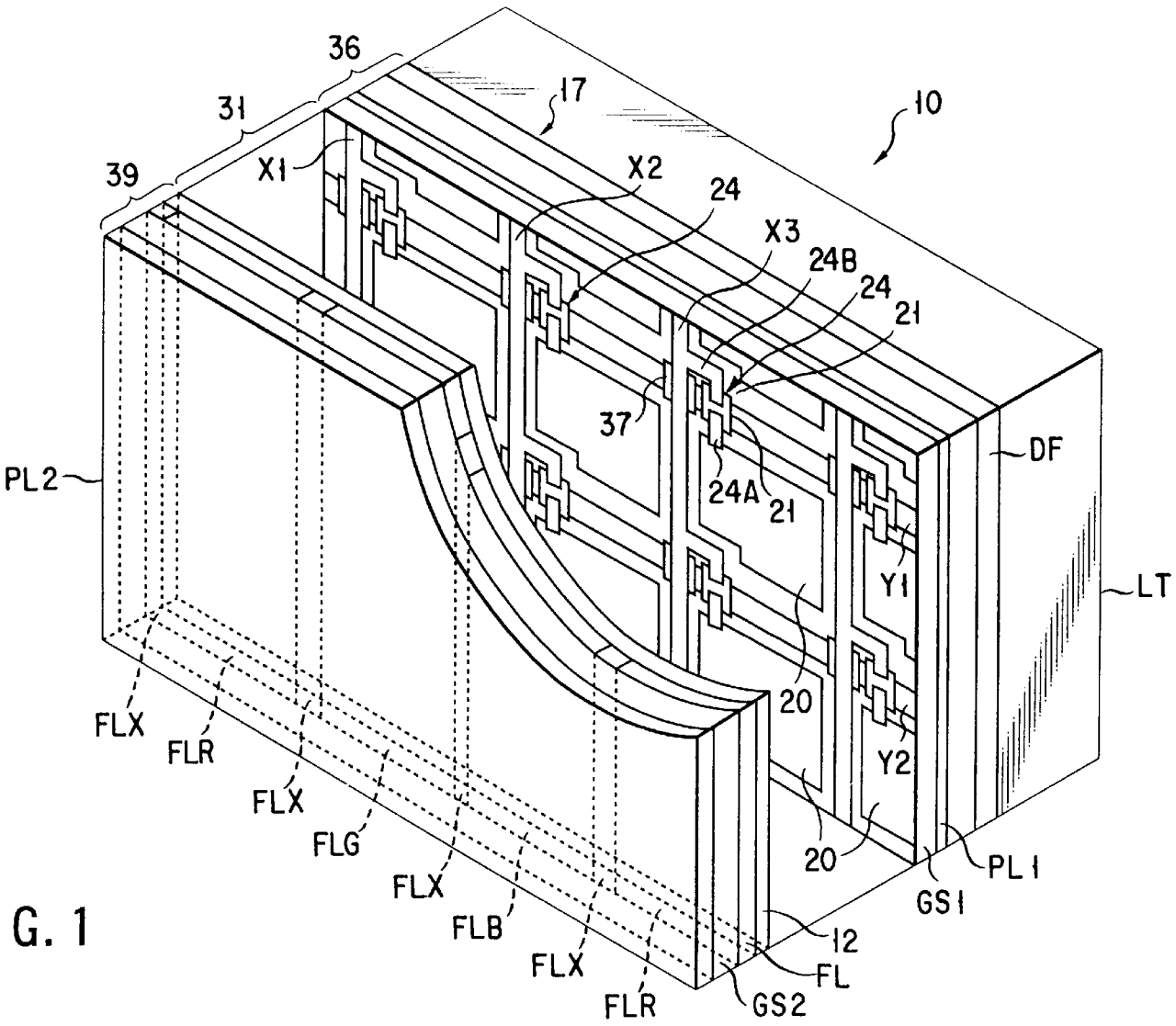
FIG. 1 is a perspective view showing part of the liquid crystal panel of a liquid crystal display device according to an embodiment of the present invention.
Figure 2:
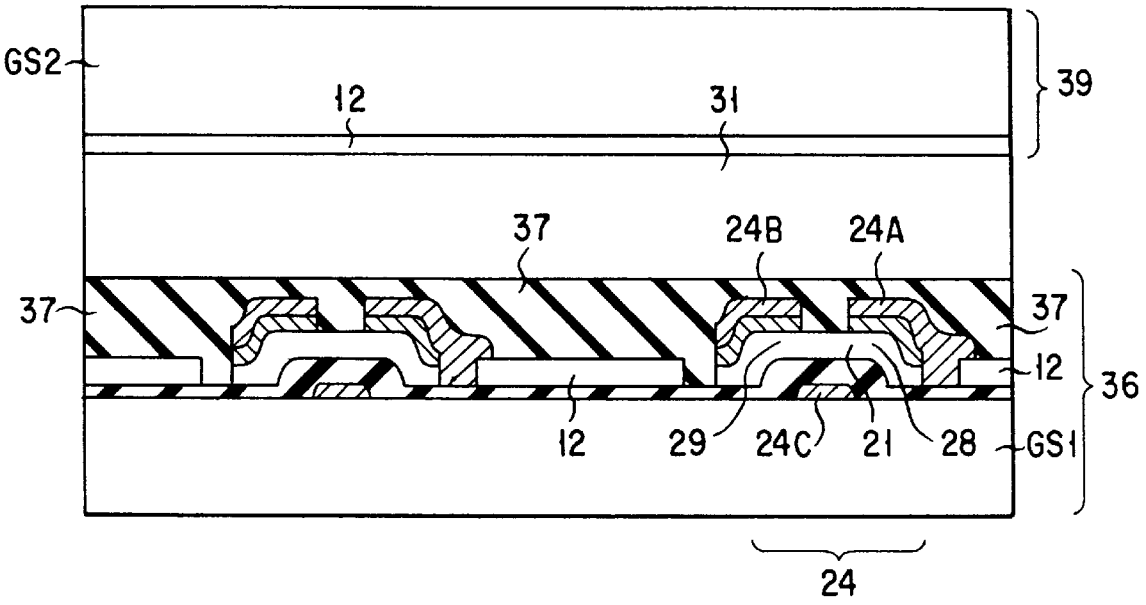
FIG. 2 is a diagram showing a cross-sectional structure of the liquid crystal panel shown in FIG. 1.

FIG. 1 shows part of a liquid crystal panel 17 of a liquid crystal display device 10, and FIG. 2 shows a cross-sectional structure of the liquid crystal panel.

The liquid crystal display device 10 includes at least the liquid crystal panel 17, an X-driver circuit 13, a Y-driver circuit 14, a control circuit 16 and a common electrode drive circuit 15. The liquid crystal panel 17 includes a common electrode, and the common electrode 12 is driven by the common electrode drive circuit 15. A display area 11 is formed in the liquid crystal panel 17.

The liquid crystal panel 17 has a structure in which a light-transmitting array substrate 36, a counter substrate 39 and liquid crystal 31 held therebetween. Polarizing plates PL1 and PL2 are attached to the outer surfaces of the liquid crystal panel 17. The liquid crystal panel 17 displays an image by selectively transmitting source light emitted from a flat back light LT placed on the back surface of the liquid crystal panel 17 through an optical diffusion plate DF.

The array substrate 36 has a matrix array of (m×3)×n pixel electrodes 20, scanning lines $Y_1$ to $Y_n$ (e.g., n=234) formed along the rows of the pixel electrodes 20, and signal lines $X_1$ to $X_{m\times3}$ (e.g., m=312) formed along the columns of the pixel electrodes 20, on a glass plate GS. The scanning lines $Y_1$ to $Y_n$ are provided to respectively select rows of the pixel electrodes 20, and the signal lines $X_1$ to $X_{m\times3}$ are provided to apply a signal voltage to the pixel electrodes 20 of a selected row.

Figure 3:
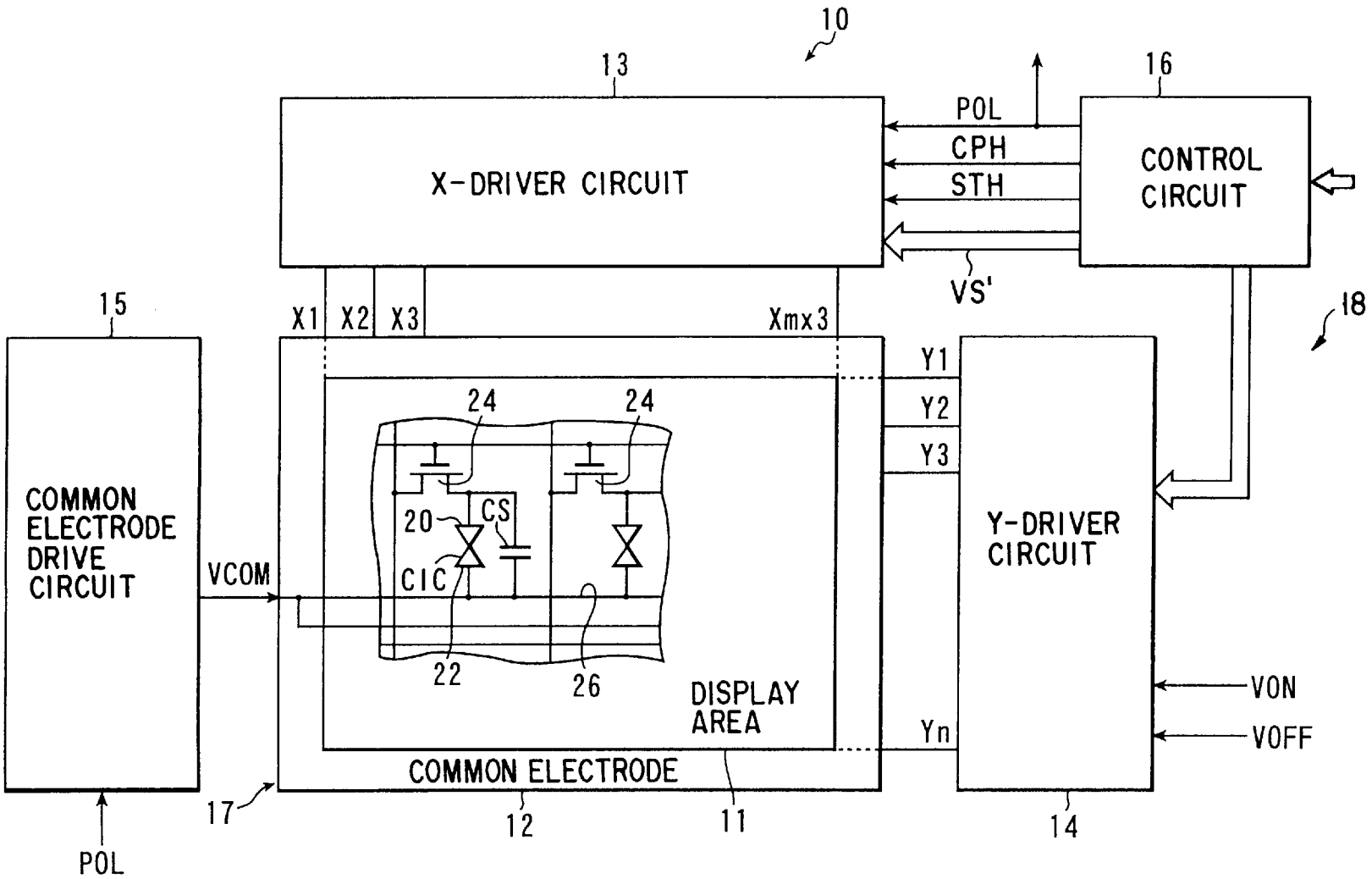
FIG. 3 is a schematic diagram showing the circuit configuration of the liquid crystal display device of the embodiment.

In the array substrate, (m×3)×n TFTs 24 are formed near the intersections between the scanning lines $Y_1$ to $Y_n$ and the signal lines $X_1$ to $X_{m\times3}$. Each of the TFTs 24 have an amorphous silicon film as an active layer, and serves as a switching element for selectively driving a corresponding one of the pixel electrodes 20. The pixel electrodes 20 provided for the respective display pixels constitute the display area 11. A gate 24C of each TFT 24 is connected to one of the scanning lines $Y_1$ to $Y_n$, and an active layer 21 is formed on the gate 24C via a gate insulating film 24D. A drain 29 connected to the active layer 21 through a contact layer is connected to one of the signal lines $X_1$ to $X_{m\times3}$. A source 28 is connected to one of all the pixel electrodes 20. Further, as shown in FIG. 3, storage capacitance lines 26 are formed along the rows of the pixel electrodes 20. A liquid crystal capacitance CLC is formed of capacitive coupling of each pixel electrode 20 and the common electrode 12. A storage capacitance CS is formed of capacitive coupling of each pixel electrode 20 and a storage capacitance line 26.

The counter substrate 39 has the transparent common electrode 12, a color filter layer FL, the glass plate GS2 and the polarizing plate PL2. The polarizing plate PL2 covers the glass plate GS2 and polarizes light transmitted through the liquid crystal cell 31. The common electrode 12, made of ITO (Indium Tin Oxide), is formed on the side of the glass plate GS2 opposite to the polarizing plate PL1 and faces the matrix array of the pixel electrodes 20. The color filter layer FL is formed to cover the common electrode 12 on the glass plate GS2. The color filter layer FL includes a plurality of color filter groups each provided for pixel electrodes 20 of the three consecutive columns. Each color filter group includes a red filter stripe FLR opposing to the pixel electrodes 20 of the first column, a green filter stripe FLG opposing to the pixel electrodes 20 of the second column, a blue filter stripe FLB opposing to the pixel electrodes 20 of the third column, and light-shielding stripes FLX formed between the adjacent two of the stripes FLR, FLG and FLB and opposing to the corresponding signal lines Xi. The liquid crystal cell 31 is in contact with a surface of the array substrate 36 via a first alignment film (not shown) and with a surface of the counter substrate 39 via a second alignment film (not shown).

In the liquid crystal panel 17 as described above, 234 horizontal pixel lines are provided, corresponding to the number of horizontal video signals per one field of an NTSC video signal, and selected sequentially in the column direction (i.e., the vertical direction of the display screen). Each horizontal pixel line includes the pixel electrodes 20 of one row, and each pixel electrode 20 forms a pixel in association with a corresponding thin film transistor 24, a corresponding portion of the polarizing plate, a corresponding portion of the liquid crystal cell, a corresponding portion of the common electrode and a corresponding portion of the color filter layer. Each horizontal pixel line includes 120 color pixel groups, each having three pixels of red, green and blue.

More specifically, the pixel electrodes 20 of the (3K-2)-numbered column (K=1, 2, 3, . . . ) are used to drive red pixels, the pixel electrodes 20 of the (3K-1)-numbered column (K=1, 2, 3, . . . ) are used to drive green pixels, and the pixel electrodes 20 of the 3K-numbered column (K=1, 2, 3, . . . ) are used to drive blue pixels.

Figure 4:
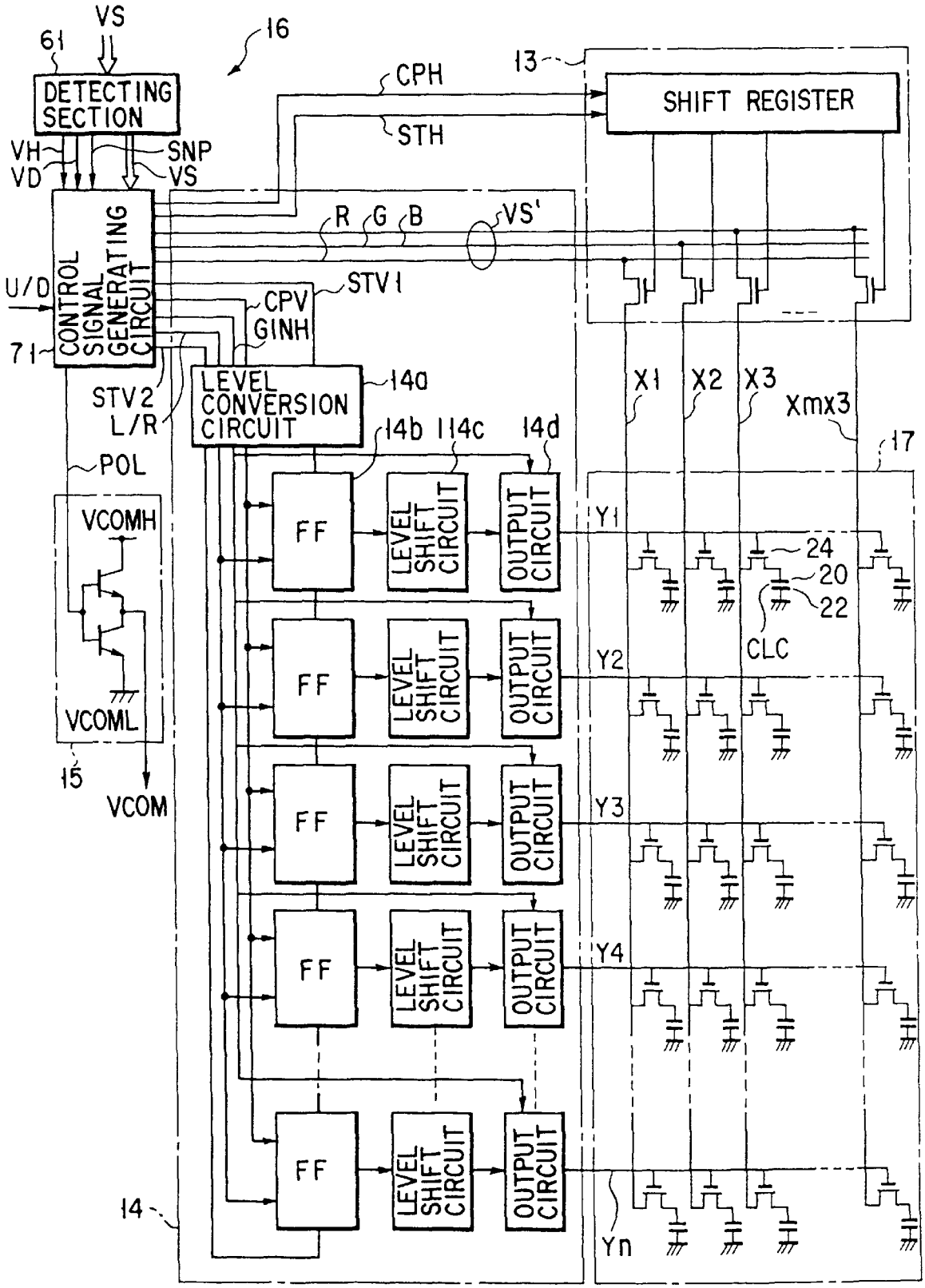
FIG. 4 is a diagram showing in detail the circuit configuration shown in FIG. 3.

FIG. 3 schematically shows the circuit configuration of the liquid crystal display device 10, and FIG. 4 shows the circuit configuration shown in FIG. 3 in more detail.

A display control unit 18 includes: a detecting section 61 for extracting a vertical sync signal VD and a horizontal sync signal VH from a video signal VS supplied externally, and detecting whether the video signal VS is of the NTSC system or PAL system; the X-driver circuit 13 for driving the signal lines $X_1$ to $X_{m\times3}$ in a manner according to the system detected by the detecting section 61; the Y-driver circuit 14 for selecting the scanning lines $Y_1$ to $Y_n$ one by one in synchronism with the operation of the X-driver which drives the signal lines $X_1$ to $X_{m\times3}$; and a control signal generating circuit 71 for supplying various control signals in a manner according to the system detected by the detecting section 61. The detecting section 61 and the control signal generating circuit 71 constitute the control circuit 16 shown in FIG. 3.

The detecting section 61 detects the system of a video signal VS by checking whether the interval between vertical sync signals VD is 1/30 second corresponding to the NTSC system, and supplies to the control signal generating circuit 71 a mode signal SPN representing one of the NTSC display mode and the PAL display mode designated based on the detection result. The mode signal SNP is supplied to the control signal generating circuit 71 along with the vertical sync signal VD and the horizontal sync signal VH. To perform inversion driving of a video signal Vs, the control signal generating circuit 71 supplies to a video signal inversion circuit a polarity inversion signal POL shown in FIG. 7(*a*) which is changed from one of 0V and +5V to the other in every horizontal scanning period or twice in one horizontal scanning period. The polarity inversion signal POL is also supplied to the common electrode drive circuit 15.

Figure 7:
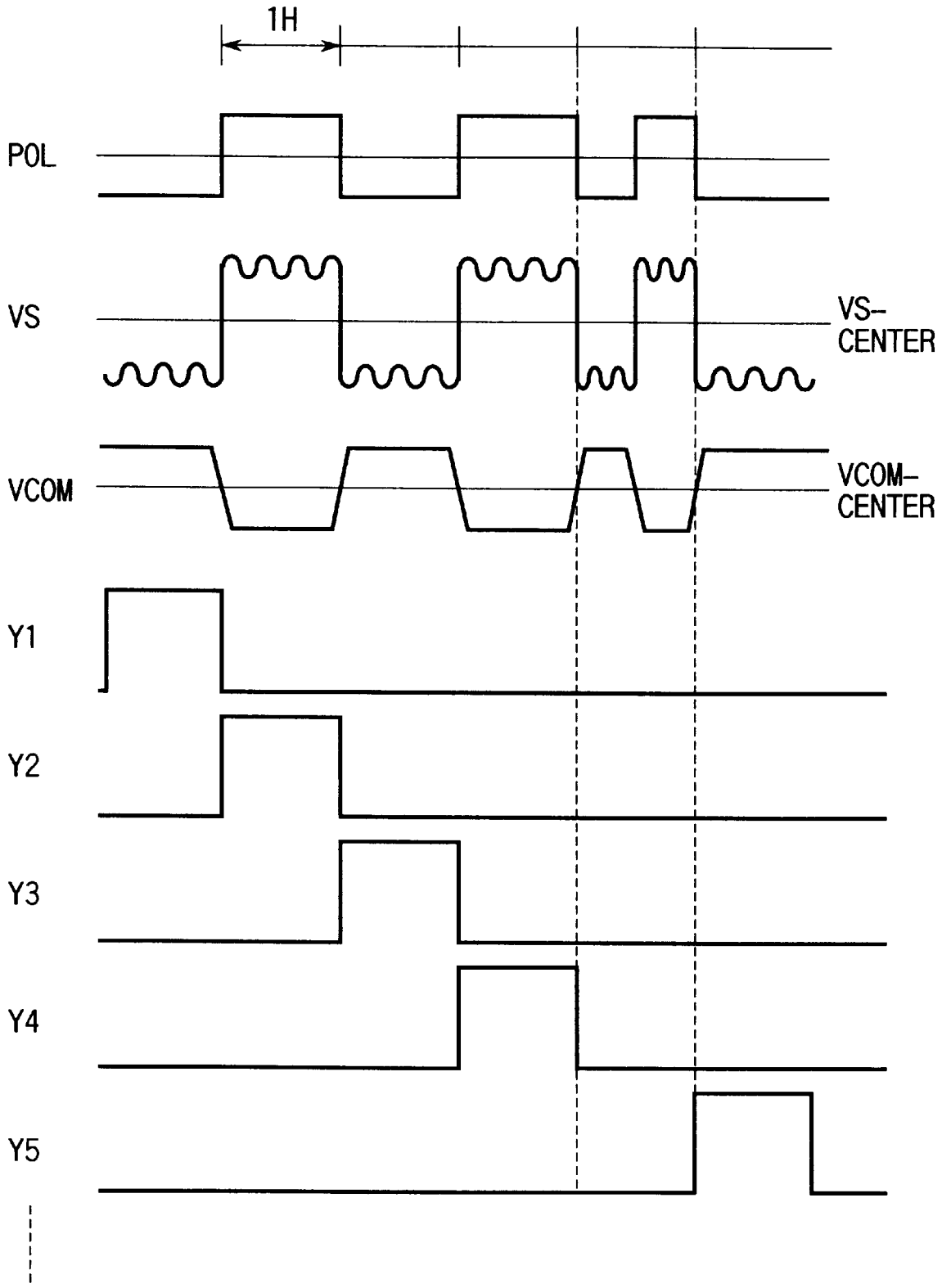
FIG. 7 is a timing chart showing the relationship between a video signal and a common electrode drive signal which is level-inverted with respect to a reference potential under the control of the control signal generating circuit shown in FIG. 5.

The X-driver circuit 13 includes shift registers of m×3 stages, a sample hold circuit, etc., and supplies to m×3 signal lines $X_1$–$X_{m\times3}$ a video signal Vs' represented in FIG. 7(*b*) supplied from the control circuit 16 in synchronism with a horizontal clock signal CPH and a start pulse STH.

The Y-driver circuit 14 sequentially selects the scanning lines Y1 to Yn, and supplies to the selected scanning line a scanning pulse as represented in FIG. 7(*d*) which rises from a source voltage VOFF (−12V) to a source voltage VON (+19V). The potentials of the non-selected scanning lines are maintained to the source voltage VOFF. More specifically, the Y-driver circuit 14 includes a level conversion circuit 14*a* for level-converting a vertical clock signal CPV, a scanning inhibition signal GINH, a shift direction designating signal L/R and scanning start pulse STV1 and TV2 which are supplied from the control signal generating circuit 71; a shift register 14*b* constituted by a series of 234 flip-flops provided for 234 horizontal pixel lines, for shifting the scanning start pulse STV1 or STV2 in response to the vertical clock signal CPV; 234 level shift circuits 14*c* respectively connected to the flipflops of the shift register 14*b*, each for shifting an output signal of a corresponding flip-flop when the scanning start pulse is held in the flip-flop; and 234 output circuits 14*d* respectively connected to the level shift circuits 14, each for outputting an output signal level-shifted by a corresponding level shift circuit 14*c* as a scanning signal for the horizontal pixel line to the corresponding one of the scanning lines Y1 to Y234. In the shift register 14*b*, the scanning start pulse STV1 is supplied to the flip-flop corresponding to the first horizontal pixel line, and the scanning start pulse STV2 is supplied to the flip-flop corresponding to the 234th horizontal pixel line. The shift direction designating signal L/R is supplied to the shift register 14*b* so as to designate the shift direction of the scanning start pulses STV1 and STV2. Thus, the Y-driver circuit 14 continuously supplies a scanning signal to the horizontal pixel line corresponding to the flip-flop which is holding the scanning start pulse STV1 or STV2 for the holding period. Further, the output operation of the output circuit 14*d* is continuously inhibited for a period that the scanning inhibition signal GINH is supplied.

When each TFT 24 in the display area 11 is turned on upon rise of a scanning pulse supplied from a corresponding scanning line, it supplies the video signal voltage from the corresponding signal line to the pixel electrode 20. The liquid crystal capacitance CLC between the pixel electrode 20 and the common electrode 12 and the storage capacitance CS between the pixel electrode 20 and the storage capacitance line 26 are charged by the signal voltage. The TFT 24 is turned off upon fall of the scanning pulse. However, even thereafter, the potential of the pixel electrode 20 is retained relatively to the potential of the common electrode 12, and updated by a new signal voltage when the TFT 24 is turned on again after one frame period.

The common electrode drive circuit 15 generates a common electrode signal VCOM for driving the common electrode 12, and inverts the polarity of the common electrode signal VCOM based on the polarity inversion signal POL from the control circuit 16. As a result, the polarity of an electric field created in the liquid crystal 31 is inverted for every scanning line, so that a direct current component can be prevented from being applied to the liquid crystal for a long time, and the driving amplitude of the video signal voltage can be lowered.

Figure 5:
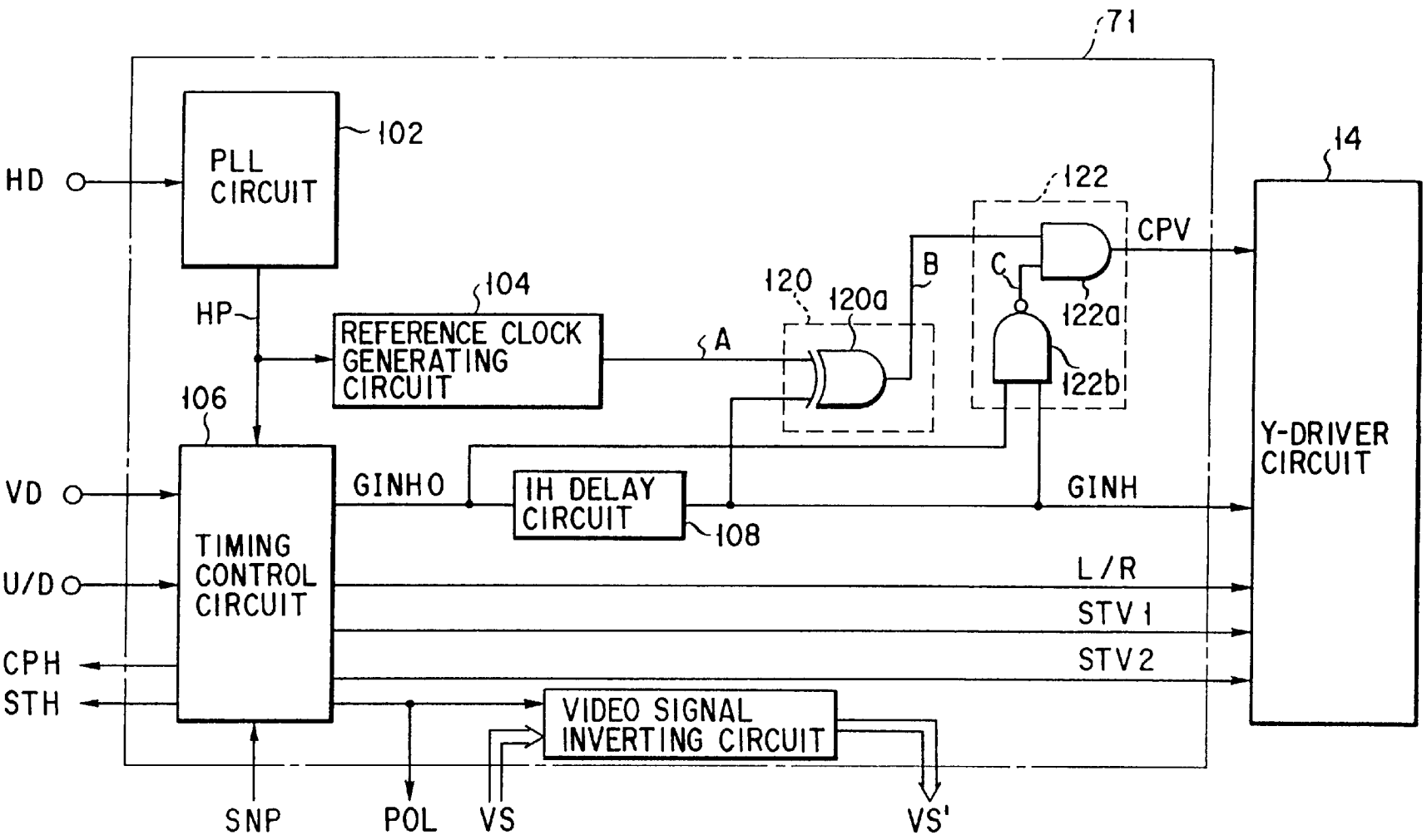
FIG. 5 is a diagram showing in detail the control signal generating circuit shown in FIG. 4.

FIG. 5 shows in detail the control signal generating circuit 71 shown in FIG. 4. The control signal generating circuit 71 includes: a PLL (phase locked loop) circuit 102 for generating a horizontal sync pulse of a frequency which is stabilized on the basis of the horizontal scanning period obtained from the horizontal sync signal HV supplied from the detecting section 61; a reference clock generating circuit 104 for generating a reference clock A synchronous to the horizontal sync pulse HP from the PLL circuit 102; a timing control circuit 106 for generating a scanning inhibition signal GINH0, a shift direction designating signal L/R, scanning start pulses STV1 and STV2 based on a horizontal sync pulse HP, a vertical sync signal HV, a mode signal SNP and an up/down inversion designating signal U/D; a 1H delay circuit 108 for outputting a scanning inhibition signal GINH obtained by delaying the scanning inhibition signal GINH0 by one horizontal scanning period; a clock inversion circuit 120 for inverting the reference clock signal A when the scanning inhibition signal GINH0 is maintained to be at a high level; and a gating circuit 122 for outputting an output signal B of the clock inversion circuit 120 when at least one of the scanning inhibition signals GINH0 and GINH is at a low level. The clock inversion circuit 120 includes an EXOR circuit 120*a* to which the reference clock signal A and the scanning inhibition signal GINH0 are input. The gating circuit 122 includes an AND circuit 122*a* and a NAND circuit 122*b*. The scanning inhibition signals GINH0 and GINH are input to the NAND circuit 122*b*, and an output signal C of the NAND circuit 122*b* and an output signal B of the gating circuit 122 are input to the AND circuit 122*a*. An output signal of the AND circuit 122 is supplied to the Y-driver circuit 14 as a vertical clock signal CPV. The up/down inversion designating signal U/D is supplied to the timing control circuit 106 so as to designate the order of selecting the horizontal pixel lines. The timing control circuit 106 determines the shift direction of the shift register 14*b* based on the up/down inversion designating signal U/D, thereby designating the shift direction in the shift direction designating signal L/R, and selects one of the scanning start pulses STV1 and STV2 based on the shift direction. The selected scanning start pulse is supplied to the shift register 14*b* at a field start timing obtained from the vertical sync signal VD. If the mode signal SNP represents the PAL display mode, the timing control circuit 106 outputs the scanning inhibition signal GINH0 which is maintained for only one horizontal scanning period (1H) in every seven horizontal scanning periods (7H). The seven horizontal scanning periods are detected by counting the number of horizontal sync pulses HP.

Further, the scanning inhibition signal GINH0 is generated in, for example, first, eighth, fourteenth, . . . horizontal scanning periods in an odd field, and second, ninth, fifteenth, . . . horizontal scanning periods in an even field.

The following is an explanation of the case where the liquid crystal display device shown in FIG. 3 serves as a liquid crystal television receiver for an NTSC video signal having 525 scanning line of television standards. Compact liquid crystal television receivers of four to six inches are currently widespread and have generally about 234 scanning lines corresponding to one interlace scanning field, although a CRT television receiver has generally about 480 scanning lines.

An operation of the aforementioned display control unit 18 will now be described. It is assumed that a scanning start pulse STV1 and a shift direction designating signal L/R are supplied to the Y-driver circuit 14 so that horizontal pixel lines can be selected in the order from the first to 234th lines. The shift register 14*b* of the Y-driver 14 shifts the scanning start pulse STV1 in response to the vertical clock signal CPV. The scanning start pulse STV1 is held in the first flip-flop from the first rise to the second rise of the vertical clock signal CPV, in the second flip-flop from the second rise to the third rise, and in the third flip-flop from the third rise to the fourth rise. In the same manner, the scanning start pulse STV1 is sequentially held in the fourth to 234th flip-flops. When the scanning start pulse STV1 is held in the first flip-flop of the shift register 14*b*, the Y-driver circuit 14 continuously supplies a scanning signal to the scanning line Y1. When the scanning start pulse STV1 is held in the second flip-flop, the Y-driver circuit 14 continuously supplies a scanning signal to the scanning line Y2. When the scanning start pulse STV1 is held in the third flip-flop, the Y-driver circuit 14 continuously supplies a scanning signal to the scanning line Y3. In the same manner, a scanning signal is supplied to the scanning lines Y4 to Y234.

In the NTSC display mode, the timing control circuit 106 does not generate a scanning inhibition signal GINH0. For this reason, the scanning inhibition signals GINH0 and GINH are kept at low level. The EXOR circuit 120*a* does not invert the reference clock signal A and outputs it as an output signal B. The NAND circuit 122*b* outputs a high level output signal C, and the AND circuit 122*a* outputs the output signal B of the EXOR circuit 120*a* as a vertical clock signal CPV. Thus, the reference signal A is supplied to the shift register 14*b* of the Y-driver circuit 14 as the vertical clock signal CPV.

Figure 6:
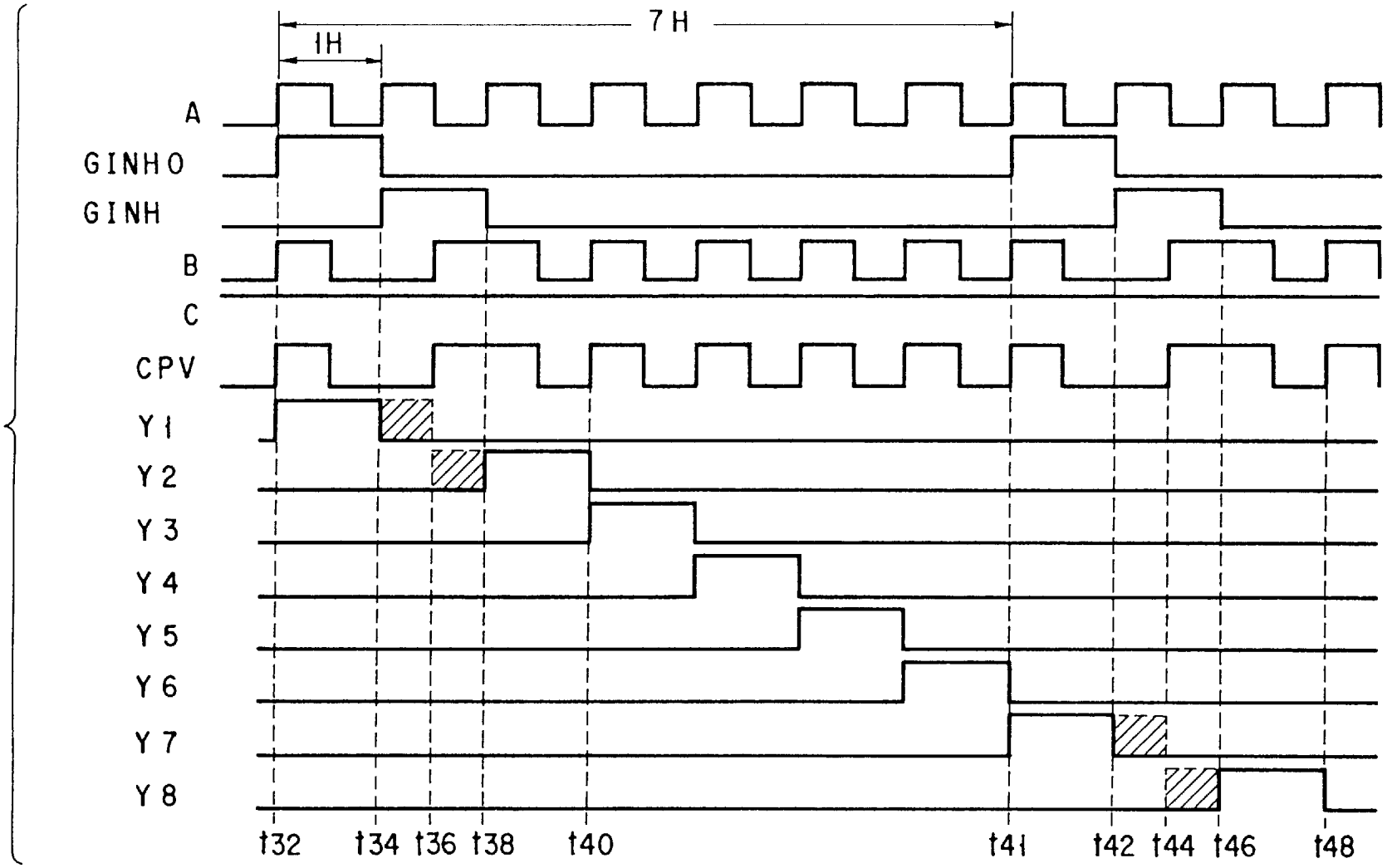
FIG. 6 is a timing chart of signals generated in the control signal generating circuit shown in FIG. 5.

In the PAL display mode, the timing control circuit 106 outputs the scanning inhibition signal GINH0 in the ratio of one to seven horizontal scanning periods, as shown in FIG. 6. When the scanning inhibition signal GINH0 is set to the high level in one horizontal period from time t32 to t34, the scanning inhibition signal GINH is set to the high level in one horizontal period from time t34 to t38, delayed from the scanning inhibition signal GINH0 by one horizontal period. When the scanning inhibition signal GINH0 is set to the high level in one horizontal period from time t41 to t42, the scanning inhibition signal GINH is set to the high level in one horizontal period from time t42 to t46, delayed from the scanning inhibition signal GINH0 by one horizontal period. When the scanning inhibition signal GINH0 is at low level, the EXOR circuit 120*a* outputs the reference clock signal A as an output signal B. When the scanning inhibition signal GINH0 is at high level, the EXOR circuit 120*a* outputs an inverted signal of the reference clock signal A as an output signal B. The NAND circuit 122*b* outputs a high level output signal C, unless both the scanning inhibition signals GINH0 and GINH are at high level. The AND circuit 122*a* outputs the inverted signal of the reference clock signal A as a vertical clock signal CPV in one horizontal scanning period in which the scanning inhibition signal GINH is maintained to be at high level. As a result, the shift timing of the shift register 14*b* is advanced by ½ horizontal scanning period. On the other hand, the output operation of the output circuit 14*d* is inhibited for one horizontal scanning period in which the scanning inhibition signal GINH is maintained to be at high level. In this horizontal scanning period, a horizontal video signal supplied from the X-driver circuit 51 to the signal lines X1 to X320 is canceled. Thus, horizontal video signals are canceled in the ratio of one to seven horizontal scanning periods.

In the structure as described above, the scanning inhibition signal GINH is used to invert the reference clock signal A, instead of masking the reference clock signal A. As a result, the scanning start pulse STV1 is held in the first register of the shift register 14*b* from time t32 to t36 and the second flip-flop of the shift register 14*b* from time t34 to t38. Since the output circuit 14*d* cannot output a scanning signal from time t34 to t38 under the control of the scanning inhibition signal GINH, the period of selecting each scanning line is maintained to be one horizontal scanning period. Since the shift operation of the shift register 14*b* is performed before the time t38, it is assured that an unnecessary pulse is prevented from being generated depending on the relationship between a delay in the wiring path of the scanning inhibition signal GINH and a response time of the shift register 14*b*.

Further, the scanning inhibition signal GINH0 is generated in the first, eighth, fourteenth, . . . horizontal scanning periods in an odd field, and the second, ninth, fifteenth, . . . horizontal scanning periods in an even field. In this case, the horizontal video signal of the same order is not canceled in both of odd and even fields. It is possible obtain an excellent image, without a stripe which may appear along a horizontal pixel line.

Figure 8:
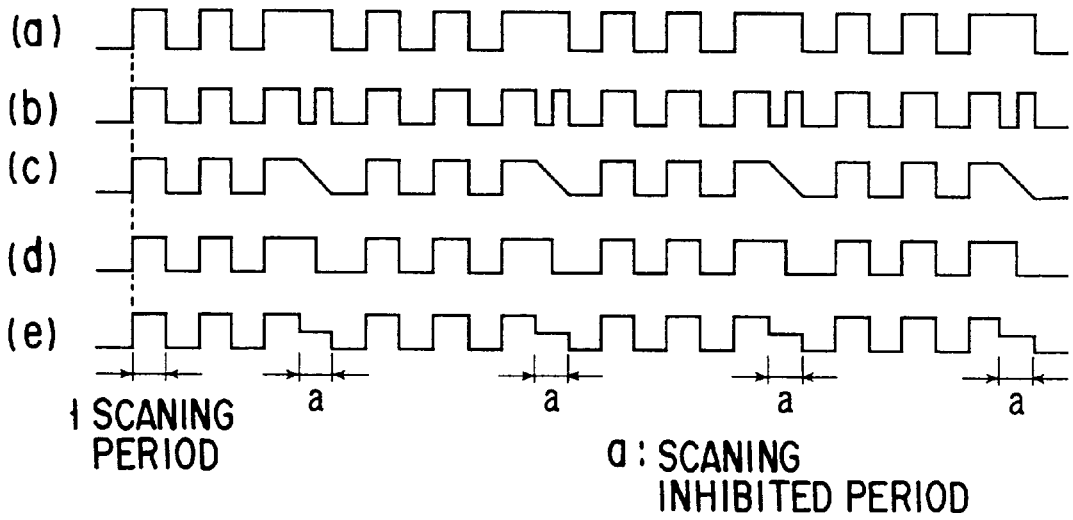
FIG. 8 is a timing chart showing waveforms of a common electrode drive signal generated when one of seven scanning lines is canceled in the liquid crystal display device according to the embodiment in comparison with conventional art.

FIG. 8 shows waveforms of a common electrode drive signal. The waveform (a) is a conventional signal waveform, whereas the waveforms (b) to (e) are signal waveforms according to this embodiment. In the case of displaying an image of the PAL standards having 625 scanning lines in a liquid crystal television receiver of 234 scanning lines, every seventh scanning line in one field is uniformly canceled, so that substantially all the video signals can be displayed. Conventionally, as indicated in FIG. 8(*a*), a signal of one level (high level in (a) of FIG. 8) is kept applied to the common electrode for a period of canceling a scanning line. Such unevenness of the DC component of the common electrode signal results in unevenness of the polarity of the liquid crystal electrode, which may generate a horizontal stripe on the screen or reduce the lifetime of the liquid crystal.

According to this embodiment, the common electrode drive circuit 15 inverts the polarity of a common electrode signal VCOM for each of six scanning periods as shown in FIG. 8(*b*) and FIG. 7(*e*). The polarity of the signal in the sixth scanning line is inverted in the former half of the seventh scanning line and, the polarity of the signal in the former half of the seventh scanning line is further inverted in the latter half of the seventh scanning line. Thus, the common electrode signal for the canceled scanning period is average-corrected within one scanning period. The DC level of a common electrode signal VCOM varies depending on the manufacturer and the product.

There are other various ways of obtaining the common electrode signal VCOM to average-correct the polarity in a canceled scanning period of every seventh scanning line. In FIG. 8(*c*), the common electrode is linearly lowered from the high level to the low level in the canceled scanning period. In FIG. 8(*d*), the level of the signal in the former half of the seventh scanning line is the same as that of the sixth scanning line and the level of the signal in the latter half of the seventh scanning line is inverted from the former half of the seventh scanning line. Further, as shown in FIG. 8(*e*), the common electrode signal VCOM in the seventh scanning line need not be divided into the former half and latter half, but can be an intermediate value between the levels of the sixth and eighth scanning lines.

Figure 9:
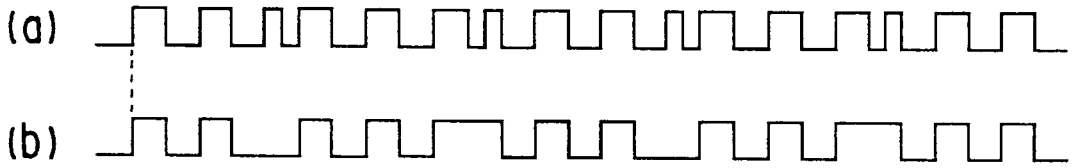
FIG. 9 is a timing chart showing waveforms of a common electrode drive signal generated when one of six scanning lines is canceled in the liquid crystal display device according to the embodiment in comparison with conventional art.
Figure 10:
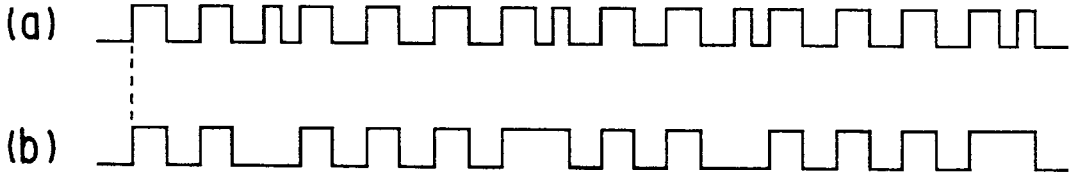
FIG. 10 is a timing chart showing waveforms of a common electrode drive signal generated when one of six scanning lines and one of eight scanning lines are alternately canceled in the liquid crystal display device according to the embodiment in comparison with conventional art.

Furthermore, one of six scanning lines may be canceled, as shown in FIG. 9(*a*), so long as the polarity inversion of the common electrode is averaged in a canceled scanning period. FIG. 9(*b*) shows a conventional signal waveform. Further, as shown in FIG. 10(*a*), two of 14 scanning lines may be canceled by alternately canceling one of six lines and one of eight lines. FIG. 10(*b*) shows a conventional signal waveform.

With the liquid crystal display device described above, when thin-out scanning is performed, one selected from an odd-number of scanning lines can be uniformly canceled without limitation in the the canceling rate. Moreover, a satisfactory display can be obtained without influence on the image quality and the lifetime of the liquid crystal.

Conventionally, if there is a time lag of about 10% between the scanning period and the polarity inversion period of a common electrode signal in consideration of optimized driving, only in latter halves of two scanning line periods, in which the polarity inversion of a common electrode signal is suspended, can be canceled. However, according to the present invention, former halves thereof can also be canceled.

In the above description of the embodiment, as an example, an video signal of the PAL system is displayed on a display panel for the NTSC system. However, the present invention is not limited to this case.

For example, the present invention can be applied to the case in which a video signal for S-VGA or XGA is displayed on a display panel for VGA. In this case, the video signal can be digital.

Further, the present invention can be applied to various types of display panel other than that described above: for example, a type in which a lateral electrical field parallel to the array substrate plane is used. Liquid crystal can be made of various materials of, for example, twist nematic (TN) type, high molecular dispersion type, or guest/host type.

Furthermore, the drive circuit described above can be constituted by a polycrystalline or monocrystalline semiconductor device integrally formed on the array substrate.

What is claimed is:

1. A flat-panel display device comprising:

a display area having a plurality of pixels;

a common electrode for electrically affecting each of said pixels;

video signal supplying means for scanning said display area and supplying a video signal to said display area;

common electrode driving means for supplying to said common electrode a driving signal whose polarity is inverted;

first control means for controlling said video signal supplying means to thin out the video signal to be supplied to said display area by suspending the scanning; and second control means for controlling said common electrode driving means such that unevenness of the polarity of said common electrode is average-corrected by the driving signal in a period during which scanning is suspended.

2. The flat-panel display device according to claim 1, wherein said second control means includes means for correcting unevenness of the polarity of said common electrode on an average for every three scanning lines.

3. The flat-panel display device according to claim 1, wherein said first control means includes means for causing said video signal supplying means to cancel one scanning line selected from an odd-number of scanning lines.

4. The flat-panel display device according to claim 1, wherein said second control means includes means for causing the polarity of the driving signal to be reversed between a former half and a latter half of the scanning suspended period.

5. The flat-panel display device according to claim 1, wherein said second control means includes means for reducing an amplitude of the driving signal in the scanning suspended period to be half a maximum amplitude of that in another period.

6. A display method of a flat-panel display device comprising: the steps of:

scanning a display area formed of pixels to supply a video signal thereto;

supplying a driving signal whose polarity is inverted to a common electrode for electrically affecting each of said pixels;

suspending scanning to thin out the video signal to be supplied to said display area; and causing the driving signal to be supplied such that unevenness of the polarity of said common electrode is average-corrected in a period during which scanning is suspended.

7. A flat-panel display device comprising:

a display panel including a display area having n lines of display pixels each of which includes a light-modulation layer responding to an electric field between a common electrode and a pixel electrode;

video signal supplying means for supplying a video signal, whose polarity is inverted with respect to a first reference voltage in a clock of an integer number of times a horizontal scanning clock, to the corresponding pixel electrodes of each horizontal pixel line; and common electrode driving means for supplying a common electrode voltage, whose polarity is inverted with respect to a second reference voltage to said common electrode in synchronism with the clock;

wherein said flat-panel display device further comprises first control means for, in a case where the video signal includes m (m>n) image scanning line signals per vertical scanning period, inhibiting the image scanning line signal from being supplied to the display pixels of the horizontal pixel lines for a predetermined period; and second control means for causing an average value of the common electrode voltage in the predetermined period to substantially coincide with the second reference voltage.

8. The flat-panel display device according to claim 7, wherein the predetermined period is a horizontal scanning period and the polarity of the common electrode voltage is inverted with respect to the second reference voltage in the predetermined period.

9. The flat-panel display device according to claim 7, wherein the predetermined period is a horizontal scanning period and the common electrode voltage is set to the second reference voltage.

10. The flat-panel display device according to claim 7, wherein the first control means inhibit the image scanning line signal from being supplied to the display pixels of the horizontal pixel line for a horizontal scanning period in every p-number of horizontal scanning periods (p is 3 or a greater odd number).

11. The flat-panel display device according to claim 7, wherein the first control means inhibit the image scanning line signal from being supplied to the display pixels of the horizontal pixel line for a horizontal scanning period in every p-number of horizontal scanning periods (p is 3 or a greater odd number) and inhibit the image scanning line signal from being supplied to the display pixels of the horizontal pixel line for a horizontal scanning period in every q-number of horizontal scanning periods (q is 3 or a greater odd number other than p).

12. A flat-panel display device comprising:

an effective display area having display pixel lines of display pixels each of which includes a light-modulation layer between first and second electrodes;

video signal supplying means for supplying to the first electrodes of each horizontal pixel line a video signal, whose polarity is inverted with respect to a first reference voltage at a first timing of each vertical scanning period; and common voltage supplying means for supplying to the second electrode a common voltage which is obtained from an input video signal and whose polarity is inverted with respect to a second reference voltage synchronously to the first timing;

scanning means for scanning said horizontal pixel lines; and control means for controlling said video signal supplying means, said common voltage supplying means, and said scanning means;

wherein said control means includes a scanning control unit for setting a horizontal scanning period in the vertical scanning period to a scanning inhibition period, and a voltage control unit for controlling an average value of the common voltage in the scanning inhibition period to substantially coincide with the second reference voltage.

13. The flat-panel display device according to claim 12, wherein the first electrodes are connected to signal lines connected to said video signal supplying means and scanning lines connected to said scanning means, via switching elements.

14. The flat-panel display device according to claim 12, wherein the voltage control unit of said control means is constructed to output a polarity inversion signal for controlling polarity inversion of the video signal and the common voltage.

15. The flat-panel display device according to claim 14, wherein polarities of the video signal and the common voltage are inverted in every horizontal scanning period based on the polarity inversion signal, and at least one-time within the scanning inhibition period.

16. The flat-panel display device according to claim 12, wherein the horizontal pixel lines coincide in number with scanning lines of a video signal of an NTSC system.

17. The flat-panel display device according to claim 12, wherein the input video signal is of a PAL system.

18. A display method for displaying and image in an effective display area having display pixel lines of display pixels each of which includes a light-modulation layer between first and second electrodes, comprising the steps of:

supplying to the first electrodes of each horizontal pixel line an video signal which is obtained from an input video signal and whose polarity is inverted with respect to a first reference voltage at a first timing of each vertical scanning period; and supplying to the second electrode a common voltage, whose polarity is inverted with respect to a second reference voltage synchronously to the first timing; and scanning said horizontal pixel lines; and wherein the display method further comprises the steps of:

setting a horizontal scanning period in the vertical scanning period to a scanning inhibition period, and controlling an average value of the common voltage in the scanning inhibition period to substantially coincide with the second reference voltage.

* * * * *